US007018688B2

(12) United States Patent
Shepherd

(10) Patent No.: US 7,018,688 B2
(45) **Date of Patent: *Mar. 28, 2006**

(54) COATING COMPOSITION

(75) Inventor: John Victor Shepherd, Essex (GB)

(73) Assignee: Arjobex Limited, Clacton-on-Sea (GB)

( * ) Notice: Subject to any disclaimer, the term of this patent is extended or adjusted under 35 U.S.C. 154(b) by 23 days.

This patent is subject to a terminal disclaimer.

(21) Appl. No.: 10/239,312

(22) PCT Filed: Mar. 22, 2001

(86) PCT No.: PCT/GB01/01263

§ 371 (c)(1),
(2), (4) Date: Feb. 4, 2003

(87) PCT Pub. No.: WO01/70509

PCT Pub. Date: Sep. 27, 2001

(65) Prior Publication Data

US 2003/0148047 A1 Aug. 7, 2003

(30) Foreign Application Priority Data

Mar. 23, 2000 (GB) ..... 0006891

(51) Int. Cl.
*B41M 5/40* (2006.01)

(52) U.S. Cl. ..... 428/32.17; 428/32.27; 428/32.28; 428/32.3; 428/32.31; 428/32.37

(58) Field of Classification Search ..... 428/32.17, 428/32.27, 32.28, 32.3, 32.31, 32.37
See application file for complete search history.

(56) References Cited

U.S. PATENT DOCUMENTS

| | | | | |
|---|---|---|---|---|
| 5,882,388 | A | 3/1999 | Adair et al. | |
| 6,214,449 | B1 * | 4/2001 | Otani et al. | 428/32.24 |
| 6,423,773 | B1 * | 7/2002 | Shepherd | 524/600 |
| 6,677,006 | B1 * | 1/2004 | Otani et al. | 428/32.25 |

FOREIGN PATENT DOCUMENTS

| | | | |
|---|---|---|---|
| EP | 470760 | A2 | 2/1992 |
| EP | 0 487 350 | A1 | 5/1992 |
| EP | 0 634 286 | B1 | 3/1997 |
| EP | 0 947 349 | A2 * | 10/1999 |
| EP | 947349 | A2 | 10/1999 |
| EP | 0 754 560 | B1 | 1/2000 |
| EP | 055711 | A2 | 11/2000 |
| GB | 1470372 | | 4/1977 |
| GB | 2177413 | | 1/1987 |
| GB | 9912321.8 | | 5/1999 |
| GB | 0006890.8 | | 3/2000 |
| JP | 63-176174 | A | 7/1988 |
| JP | 5-85033 | A | 4/1993 |
| JP | 10-182962 | A | 7/1998 |
| WO | WO 98/16396 | | 4/1998 |

* cited by examiner

*Primary Examiner*—B. Shewareged
(74) *Attorney, Agent, or Firm*—Buchanan Ingersoll PC

(57) ABSTRACT

A composition, preferably a synthetic paper, is disclosed comprising a plastics substrate having a printable polymer coating, wherein the coating has a density of from 0.3 to 0.7 g/cm$^3$. The low density provides improved adhesion and printability properties compared with the prior art, and permits the coating to be applied in a single layer of uniform density.

15 Claims, No Drawings

COATING COMPOSITION

This invention relates to a coating composition for a plastics substrate.

Plastics substrates are generally impervious to materials such as printing inks. Thus, they tend to be unsuitable for direct use in ink-based printing processes because the ink has a tendency to remain at the surface of the substrate, without being absorbed.

It is well known to modify the surface characteristics of a plastics substrate by applying an absorbent coating composition to the substrate's surface. Examples of such coatings arc described in GB 2177413A, and EP 1055711A. The coating compositions described comprise an absorbent filler and polymeric binder. The filler, typically having an oil absorbency of between 20 and 40 $cm^3/g$, renders the substrate more absorbent to ink, whilst the binder binds the filler to the substrate's surface.

Binders generally have densities of above 0.9 $g/cm^3$, whilst fillers generally have densities in the region of 2 to 4 $g/cm^3$. Accordingly, the resulting coating compositions invariably have densities of greater than 0.9 $g/cm^3$.

Although such coating compositions may be employed to render plastics substrates sufficiently absorbent for most printing operations, they are unsuitable for use in ink jet printers. This is because such coatings are substantially water resistant: if they are used for ink jet printing, the ink jet inks can take several minutes to dry and can spread during this time to give an indistinct image.

EP 947349A discloses an inkjet recording paper comprising a paper substrate having a pair of ink-receiving layers, the top layer having a density of 0.4 to 0.6 $g/cm^3$ and the underneath layer being from 0.05 to 0.5 $g/cm^3$ denser than the top layer. Whilst this system may be suitable for paper substrates, which have very favourable surfaces for absorption and adhesion, there is no suggestion that it would work with plastic substrates, which are non-absorbent and much more difficult to adhere to than paper substrates. Furthermore, the need for a double layer coating increases the complexity of the manufacturing process.

We have now developed a new coating composition having improved absorbency characteristics which can be successfully used on a plastics substrate, and which is capable of being used on such a substrate in the form of a single layer of uniform density.

Accordingly the present invention provides a printable medium comprising a plastics substrate having a printable polymer coating, characterised in that the coating has a density of from 0.3 to 0.8 $g/cm^3$.

It is preferred that the coating forms 1 to 40% of the total weight of the substrate and coating. It is also preferred that the coating is in the form of a single layer of substantially uniform density.

Preferably, the printable medium is a synthetic paper. The term "synthetic paper" is well known in the art, and means a plastics material having the feel and printability characteristics of cellulose paper. Preferred plastic substrates are described and claimed in GB 1470372 incorporated herein by reference.

It is important that the density of the present coating is maintained within the specified range. At densities lower than 0.3 $g/cm^3$, the integrity of the coating is compromised. At densities above 0.8 $g/cm^3$, the absorbency of the coating is decreased to less effective levels. Preferably, the density range is between 0.4 and 0.7 $g/cm^3$, more preferably 0.6 and 0.45 $g/cm^3$. The desired density range may be achieved by selecting a filler with an oil absorption of greater than 50 $cm^3/g$. Preferably, the oil absorption of the filler is between 50 and 200 $cm^3/g$, more preferably, between 80 and 200 $cm^3/g$. Additionally, or alternatively, the binder to filler dry weight ratios may be adjusted until the desired density is achieved.

The polymeric binder employed in the coating of the present invention may be in aqueous solution or latex suspension, preferably the latter. The binder may comprise a single polymer or a mixture of polymers. For example, the binder may comprise starch or protein modified chemically or physically, by the addition of other polymeric species to provide the required functional groups. Alternatively or additionally, the polymeric binder may comprise a styrene-butadiene copolymer, an acrylic polymer or copolymer, a vinyl acetate polymer or copolymer, a vinyl acetate-ethylene copolymer, a polyvinyl alcohol polymer or copolymer, and/or a polyvinyl pyrrodidone polymer or copolymer. Preferably, a styrene-butadiene, acrylic or vinyl acetate-ethylene copolymer is employed. Such binders may also contain other polymeric species provided they do not interfere undesirably with the properties of the coating. For example, a styrene-butadiene copolymer latex may be incorporated in an acrylic latex binder to modify the flexibility and toughness of a dried coating.

The binder content of the aqueous coating composition of this invention is chosen to suit individual requirements. Preferably, the concentration of binder in the coating composition is no more than 40%, more preferably less than 30% and most preferably less than 25% of the total dry weight of the coating composition.

The filler may be any suitable inert filler which is capable of rendering the coated plastics substrate absorbent to ink. Preferably, the filler has a pore volume of greater than 0.8 $cm^3/g$, preferably greater than 1.0 $cm^3/g$ and more preferably greater than 1.2 $cm^3/g$. Examples of suitable fillers include calcium carbonate, china clay, silica (e.g. amorphous silica), barium sulphate, calcium sulphate, aluminium oxide and aluminium hydroxide. Preferably, the filler is a synthetic silica. More preferably, a synthetic silica having a pore volume of greater than 1.22 $cm^3/g$. The filler may form 60 to 95%, preferably 60 to 90%, most preferably 70 to 90% of the dry weight of the coating composition.

The binder to filler dry weight ratio may be between 2:3 and 1:19, preferably between 1:3 and 1:10, and more preferably between 1:5 and 1:8.5.

The coating utilised in the present invention may further comprise a polyamide epichlorohydrin. This is a cross-linking agent which has the dual function of localising the dye at the surface of the coating and reducing the coating's susceptibility to water. Any suitable polyamide epichlorohydrin may be employed, including those sold under the trade marks KYMENE and POLYCUP. Such additives are particularly useful for the reduced density coatings of the present invention. This is because as well as absorbing ink efficiently, such coatings have a tendency to absorb water. Water absorbed into the coating may dissolve the ink, spoiling the printed image. Furthermore, such highly absorbent coatings also have a tendency to absorb the ink itself into the body of the coating, drawing the ink away from the surface and thereby reducing the brilliance of the printed image. By incorporating a polyamide epichlorohydrin into such coatings, the coating is rendered more water resistant, and the extent to which ink dye migrates into the body of the coating is reduced. Thus, the potential problems arising from the enhanced absorbency of reduced density coatings can be alleviated. Without the polyamide epichlorohydrin the dye remains soluble in water and can be smudged when wetted with water.

In an alternative embodiment, a separate coating of polyamide epichlorohydrin is applied on top of the coating of the present invention.

The coating composition may also comprise an additional insolubilizing agent to render the polymeric binder more water resistant. Suitable ionic insolubilizing agents include ammonium zinc carbonate, disodium tetraborate (BORAX) and, preferably, ammonium zirconium carbonate. For latex-based coating compositions the polyanionic compounds are suitable and ammonium zirconium carbonate are particularly preferred.

When an insolubilizing agent is employed, the polymeric binder preferably contains a functional group on the polymer chain of at least one polymeric constituent, which is capable of reacting with the insolubilizing agent to render the binder insoluble. Examples of such functional groups include carboxyl groups, amines, alcohols, polyols, hydroxyls and sulfides. These groups may react with the insolubilizing agent when the coating composition is heated, for example, to 60° C. or more. Heating, however, is not necessary and the insolubilising agent may react with the binder even at temperatures as low as 10° C.

The coating composition may contain additional components, such as processing aids. Examples of suitable processing aids are polyacrylates, wax dispersions, stearates and anti foaming compositions. These processing aids may improve the behaviour of the coating composition when being applied to a substrate using coating machinery.

As well as rendering the substrate suitably absorbent to ink, the coating composition described above also enhances the thermal properties of the plastics substrate. Accordingly, a synthetic paper made according to the present invention is resistant to the relatively high temperatures encountered, for example, in laser printing. It is therefore less likely to suffer from curl or shrinkage in comparison with synthetic papers comprising conventional coating compositions.

Preferably, the plastics substrate of the synthetic paper is formed from an orientable thermoplastics olefin polymer, such as high density polyethylene (HDPE). The orientable thermoplastics olefin polymer may be blended with a metal resinate, such as calcium zinc resinate, or another rosin-derived voiding agent. In a preferred embodiment, the plastics substrate is formed from a composition comprising a copolymer of HDPE, calcium zinc resinate, polystyrene, HDPE homopolymer, rosin-derived voiding agent, calcium carbonate filler, titanium dioxide, styrene butadiene and calcium oxide. The plastics substrate is preferably stretch-voided, and more preferably, biaxially oriented, for example, by simultaneous biaxial stretching in the machine and transverse direction. Preferably, the substrate is stretched to provide a 3–7:1, more preferably, 3–5:1, for example, 4:1 stretch in each of the machine and transverse directions.

The plastic substrate may be coated with the coating by any suitable technique, such as roller coating with air-knife metering. However, print-coating may also be employed. The thickness of the wet coating may for example be in the range appropriate to give a dry coating weight of from 5 to 50 g/m$^2$, preferably in the region of 10–30 g/m$^2$.

Drying of the wet coating may be by any means whereby the temperature may be adequately controlled to keep the coated plastics substrate substantially undistorted. For a polyethylene sheet, this temperature is preferably below 100° C. but above 60° C. In the case of coatings on synthetic papers for example, air drying temperatures in the region of 60° C.–70° C. may be advantageously employed to achieve adequately rapid drying while preserving a uniform dried coating.

It will be appreciated that the plastic substrate may be comprised of any plastics material. However, particularly where the surface of such plastics material is strongly hydrophobic, modification of the surface by known chemical or corona discharge treatment may be desirable prior to coating to assist wetting by the coating composition during the coating to assist wetting by the coating composition during the coating operation and/or to assist in achieving a good bond between dried coating and substrate.

EXAMPLE 1

A sheet of voided, filled, biaxially orientated polyethylene sheet was made using the following components:

| | Parts by weight |
|---|---|
| Rigidex 002/55 polyethylene (copolymer) of MFI* 0.2 g/10 min and density 0.955 kg/m$^3$ (supplied by BP Chemicals Ltd (BPCL)) | 100 |
| Rigidex HD6070EA high density polyethylene of MFI 7.5 and density 0.96 Kg/m$^3$ (supplied by BPCL) | 17.6 |
| Polystyrene Grade HF888 (supplied by BPCL) | 4.8 |
| Ennesin ZC14 (Calcium-zinc resinate) (supplied by Leo Frenkel Ltd) | 9.6 |
| Cariflex TR1102 Styrene-butadiene-styrene block copolymer (supplied by Shell UK Ltd) | 0.6 |
| Calcium Carbonate-anhydrous 2.5 micron particle size (supplied by Himont UK Ltd) | 21.0 |
| Titanium dioxide (Rutile) (RCR2 supplied by Himont UK Ltd) | 5.8 |
| Armostat 400 (antistatic agent) (supplied by AKZO Chemicals Ltd) | 0.14 |
| Armostat 375D (antistatic agent) (supplied by AKZO Chemicals Ltd) | 0.35 |
| Caloxal CPA calcium oxide (supplied by Sturge Lifford Ltd) | 0.58 |
| Calcium Stearate (supplied by RTZ Chemicals Ltd) | 0.04 |
| Irganox B215 antioxidant (supplied by CIBA Geigy Industries Ltd) | 0.29 |

*MFI = Melt Flow Index

Some of these components were first mixed together as separate, melt blended, cooled and diced masterbatches (see A1 and A2 below).

| | |
|---|---|
| **A1** | |
| Calcium Carbonate | 60% |
| Rigidex HD 6070EA | 39.6% |
| Armostat 400 | 0.4% |
| **A2** | |
| Titanium dioxide | 60% |
| Rigidex HD 6070EA | 39.6% |
| Calcium Stearate | 0.4% |

A1 and A2 were then intermixed in appropriate proportions with the remainder of the ingredients of the composition and fed to a compounding extruder. The composition was melt blended at approximately 200° C., and then extruded, cooled and diced to form Compound A.

Compound A was fed to an in-line extruder of a twin extruder-distributor-sheeting die co-extrusion arrangement. The extrudate was cooled, and then subjected to simultaneous biaxial stretching using the apparatus described with reference to Figures 1 to 9 of GB 1 442 113, and arranged to provide a 4:1 stretch in each of the machine (MD) direction and transverse direction.

The resulting plastics substrate was coated using a coating composition prepared by stirring the following components together at relatively low shear.

| Components | Parts by Weight |
|---|---|
| Water | 80 |
| Surfonyl 420 | 0.14 |
| DMAMP | 0.15 |
| Syloid W500 | 104 |
| Acronal 866 | 55 |
| Kymene SLX2 | 1.5-pre mix before addition |
| Water | 1.5-pre mix before addition |

Surfonyl 420 is a non ionic surfactant ex Air Products.
DMAMP is 2-dimethylamino-2-methyl-1-propanol made by Angus Chemie.
Syloid W500 is an amorphous silica with pore volume of 1.8 g/cm$^3$ and oil absorption of 75 manufactured by Grace Davison.
Acronal 866 is an styrene-acrylic copolymer dispersion 50% in water (MFT = 40° C.) manufactured by BASF.
Kymere SLX2 is a polyamide-epichlorohydrin resin from Hercules 13% active.

The plastics substrate (70 g/m$^2$) was coated with the above mixture using a wire wound bar. After drying at 60° C. for 10 minutes in a laboratory oven the coat weight was 30 g/m$^2$. The density of the coating was determined by measuring the average thickness of the coating (by difference) and the weight was divided by the volume derived from this thickness. This density was 0.55 g/cm$^3$. The material was left for 3 days at ~20° C.

A Hewlett Packard Deskjet 600 was loaded with the coated substrate, the coated side aligned towards the inkjet head. Printing gave sharp images with clear colour and instant drying. The image was water resistant and when moistened and rubbed the image was not smudged.

EXAMPLE 2

A coating composition was prepared by stirring the following components together at relatively low shear.

| Components | Parts by Weight |
|---|---|
| Water | 40 |
| Surfonyl 420 | 0.09 |
| Dispex N40 | 0.05 |
| DMAMP | 0.13 |
| Syloid W500 | 52 |
| Acronal 504 | 26 |
| Acrosol C50L | 0.15 |
| Steracol FD | 0.3 |
| Kymene SLX2 | 0.15-pre mixed |
| Water | 0.15-pre mixed |

Dispex N40 is an anionic dispersant from Allied Colloids
Acronal 504 is an acrylonitrile/n-butyl acrylate/styrene copolymer (MFT = 0) made by BASF.
Acrosol C50L is an acrylic ester dispersion made by BASF.
Steracol FD is an acrylic dispersion made by BASF.

A plastic sheet was made as described in Example 1 above to give a film weight of 180 g/m$^2$. The resultant sheet was coated with the above formulation with a wire wound bar to give a coat weight of 40 g/m$^2$ on one side after drying at 60° for 10 minutes (total weight=220 gsm). The coating had a density of approximately 0.5 g/cm$^3$.

A Hewlett Packard Laserjet 111 p was loaded with the coated sheet, the coated side aligned towards the laser head. Printing gave sharp images. The image was water resistant and when moistened and rubbed the image was not smudged.

EXAMPLE 3

A coating composition was prepared by stirring the following components together using a high speed stirrer. The final mixture was stirred for a further 60 minutes.

| Components | Parts by Weight |
|---|---|
| Water | 40 |
| Surfonyl 420 | 0.05 |
| Nopco 1186-A | 0.02 |
| Martifin OL 107 | 3 |
| Microcal ET | 17 |
| Acronal 728 | 12 |
| Acrosol C 50 L | 0.1 |
| Aluminiumoxid C | 0.7 |
| Kymene SLX 2 (diluted with its own weight of water) | 8 |

Martifin OL 107 is an aluminium hydroxide supplied by Matinswerke GmbH with an oil absorbtion of 40–55 ml per 100 gram.
Nopco 1186-A is the disodium salt of di octyl sulfosuccinate
Microcal ET is a precipitated silica supplied by Crossfield with an oil absorption of 170 g per 100 grm and a surface area of 60 m$^2$/g.
Acronal 728 is an aqueous anionic of a styrene/n-butanol copolymer from BASF
Aluminiumoxid C is an aluminium oxide with cationic surface properties.

This mixture was coated onto a 70 g/m$^2$ plastic substrate made as in Example 1 to give a dry coat weight of 20 gsm. The density of this coating was 0.4 g/cm$^3$. An overcoating was made by stirring 0.64 g of Aluminiumoxid C into 41 g of Kymene SLX 2. This overcoating was applied to the dried coating above to give an additional coat weight of about 0.1 g/m$^2$. The density of the dried overcoating on its own was approximately 1 g/cm$^3$. The measured density of the total coating remained at about 0.4 g/cm$^3$ i.e. the overcoating was at such a level that it did not alter the overall density to a measurable extent.

The sample was printed on a Epson Color 850 ink jet printer and gave an image with good definition and bright colours that resisted water.

COMPARATIVE EXAMPLE

The substrate of Example 1 was coated using a coating made as described in the Example of GB 2177413. The coated product had a coat weight of 50 g/m$^2$. A Hewlett Packard LaserJet 111p was loaded with the coated sheet, the coated side aligned towards the laser head. The resulting image showed shrinkage of approximately 0.2% across the sheet and 0.2% along the sheet and had a more pronounced curl than the sheets falling within the scope of the present invention (Examples 1 to 3).

The invention claimed is:

1. A printable medium which is a synthetic paper comprising a plastics substrate having a printable polymer coating, wherein the plastics substrate is formed from an orientable thermoplastics olefin polymer that is biaxially oriented, with a 3–5:1 stretch in each of the machine and transverse directions, and the coating is in the form of a single layer of uniform density and has a density of from 0.3 to 0.8 g/cm$^3$.

2. A printable medium according to claim 1, wherein the density of the coating is from 0.4 to 0.7 g/cm$^3$.

3. A printable medium according to claim 2, wherein the density of the coating is from 0.45 to 0.6 g/cm$^3$.

4. A printable medium according to claim 1, wherein the coating forms from 1 to 40% of the total weight of the substrate and coating.

5. A printable medium according to claim 1, wherein the coating comprises a binder selected from a styrene-butadiene, acrylic or vinyl acetate-ethylene copolymer.

6. A printable medium according to claim 1, wherein the coating further comprises a polyamide epichlorohydrin.

7. A printable medium according to claim 1, wherein a layer of polyamide epichlorohydrin is applied on top of the coating.

8. A printable medium comprising a plastics substrate having a printable polymer coating, wherein the coating has a density of from 0.3 to 0.8 g/cm$^3$ and includes an ionic or polyanionic insolubilizing agent that comprises ammonium zinc carbonate, disodium tetraborate or ammonium zirconium carbonate.

9. A printable medium according to claim 8, wherein a binder of the coating contains a functional group on a polymer chain of at least one polymeric constituent thereof, which is capable of reacting with the insolubilizing agent to render the binder insoluble.

10. A printable medium according to claim 1, wherein the orientable thermoplastics olefin polymer is blended with a rosin derived voiding agent.

11. A printable medium according to claim 10, wherein the plastics substrate is formed from a composition comprising a copolymer of HDPE, rosin derived voiding agent, polystyrene, HDPE homopolymer, calcium carbonate filler, titanium dioxide, styrene butadiene and calcium oxide.

12. A printable medium comprising a plastics substrate having a printable polymer coating, wherein the plastics substrate is formed from a composition comprising a copolymer of HDPE, rosin derived voiding agent, polystyrene, HDPE homopolymer, calcium carbonate filler, titanium dioxide, styrene butadiene and calcium oxide, and the coating has a density of from 0.3 to 0.8 g/cm$^3$.

13. A printable medium according to claim 12, wherein the plastics substrate is biaxially oriented, with a 3–5:1 stretch in each of the machine and transverse directions.

14. A printable medium according to claim 1, wherein the coating contains a filler having an oil absorption of between 50 and 200 cm$^3$/g.

15. A printable medium which is a synthetic paper comprising a plastics substrate having a printable polymer coating, wherein the plastics substrate is formed from an orientable thermoplastics olefin polymer comprising a copolymer of HDPE, rosin derived voiding agent, polystyrene, HDPE homopolymer, calcium carbonate filler, titanium dioxide, styrene butadiene and calcium oxide, and the coating is in the form of a single layer of uniform density and has a density of from 0.3 to 0.8 g/cm$^3$.

* * * * *